US006328158B1

(12) United States Patent
Bisbal et al.

(10) Patent No.: US 6,328,158 B1
(45) **Date of Patent: *Dec. 11, 2001**

(54) PRODUCT ENSEMBLE DISPLAY AND CARRYING PACKAGE

(75) Inventors: Maribel Bisbal, Huntington Beach, CA (US); Derrick L. Anderson, Sterling Heights, MI (US); Harvey J. Simon, Charlotte, NC (US); Tracy A. Smith; Timothy J. Landers, both of Fort Mill, SC (US)

(73) Assignee: Springs Industries, Inc., Fort Mill, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/535,868

(22) Filed: Mar. 27, 2000

(51) Int. Cl.[7] ..... B65D 69/00

(52) U.S. Cl. ..... 206/223; 206/459.5; 383/40; 383/106

(58) Field of Search ..... 206/351, 494, 206/38, 223, 459.5, 232, 776, 778; 383/38, 40, 97, 106; 229/162, 71; 250/106; 190/109, 115, 127, 903

(56) References Cited

U.S. PATENT DOCUMENTS

| | | | | |
|---|---|---|---|---|
| D. 243,637 | | 3/1977 | Rabinowitz . | |
| D. 244,723 | | 6/1977 | Rabinowitz . | |
| D. 273,534 | | 4/1984 | Weinreb . | |
| D. 273,941 | | 5/1984 | Farber . | |
| D. 340,387 | | 10/1993 | Melk . | |
| D. 349,428 | | 8/1994 | Krugman . | |
| 1,884,402 | * | 10/1932 | Van Devanter | 190/109 |
| 2,061,091 | * | 11/1936 | Roth | 190/127 |
| 2,086,895 | * | 7/1937 | Cart | 190/127 |
| 2,087,273 | * | 7/1937 | Wittenberg et al. | 190/109 |
| 2,517,757 | | 8/1950 | Adlerstein . | |
| 3,087,605 | | 4/1963 | Kester . | |
| 3,842,977 | * | 10/1974 | Hollander | 206/407 |
| 3,865,234 | | 2/1975 | Kester . | |
| 3,870,132 | * | 3/1975 | Hanley | 190/52 |
| 3,989,080 | | 11/1976 | Koszegi . | |
| 4,290,525 | | 9/1981 | Sisson . | |
| 4,301,898 | * | 11/1981 | Plough et al. | 190/903 |
| 4,350,274 | | 9/1982 | Morgan . | |
| 4,463,789 | | 8/1984 | Leiserson . | |
| 4,738,363 | | 4/1988 | Hudson . | |
| 4,805,749 | | 2/1989 | Gerch . | |
| 4,819,793 | | 4/1989 | Willard et al. . | |
| 4,852,739 | | 8/1989 | Franco . | |

(List continued on next page.)

*Primary Examiner*—Shian Luong
(74) *Attorney, Agent, or Firm*—Alston & Bird LLP

(57) ABSTRACT

A display and carrying package is provided which is particularly adapted for displaying and carrying a bedding ensemble, but which could be used for displaying and carrying any ensemble of products of different sizes. The package is in the form of a closed flexible bag, preferably box-shaped, having generally flat transparent front and rear walls and, preferably, having non-transparent side and top walls connected thereto. The bag preferably includes a zipper for closing and opening the bag to provide access to the interior of the bag. The ensemble of products of different sizes is positioned inside the bag with the large ensemble product in juxtaposition to the transparent front bag wall for viewing therethrough and the other smaller ensemble products are positioned inside the bag, preferably in pockets attached to the inside of the rear wall, in juxtaposition to the rear transparent wall and in side-by-side position for being viewed from the outside through the transparent rear wall.

6 Claims, 3 Drawing Sheets

U.S. PATENT DOCUMENTS

| | | | | |
|---|---|---|---|---|
| 4,917,160 | * | 4/1990 | Hart et al. | 150/106 |
| 4,984,906 | | 1/1991 | Little . | |
| 5,255,833 | | 10/1993 | McAllister . | |
| 5,725,382 | * | 3/1998 | Walter et al. | 206/581 |
| 5,762,260 | | 6/1998 | Goglio . | |
| 5,782,360 | | 7/1998 | Markson . | |
| 5,791,488 | | 8/1998 | Lee . | |
| 5,896,962 | * | 4/1999 | Smith et al. | 190/107 |
| 6,024,219 | * | 2/2000 | Froechlich et al. | 206/459.5 |
| 6,161,959 | * | 12/2000 | Abraham | 383/97 |

* cited by examiner

PRODUCT ENSEMBLE DISPLAY AND CARRYING PACKAGE

FIELD OF THE INVENTION

This invention relates to a display and carrying package for an ensemble of products of different sizes and particularly for an ensemble of bedding articles, which is characterized by providing views from the outside of the package for each product or bedding article within the package.

BACKGROUND OF THE INVENTION

Heretofore, ensembles of various products of different sizes have been packaged in a variety of different ways for displaying the ensemble and for carrying the ensemble away from a retail store or the like after purchase thereof.

In the bedding field, a highly successful commercial display and carrying package for a bedding ensemble has been marketed under the trademark BED-IN-A-BAG®. This BED-IN-A-BAG® package for a bedding ensemble is in the form of a clear plastic bag having front and rear walls and a zipper at the top thereof for closing and opening the bag to provide access to the interior of the bag. The bedding ensemble packaged within this bag typically includes a folded bed cover of a folded size generally corresponding to the size of the front and rear bag walls, and other folded bedding articles, such as sheets and pillow covers, which are of smaller folded sizes and which were positioned inside the folded bed cover. The folded bed cover with the smaller folded bedding articles positioned inside or between the folds are placed inside the bag so that the folded bed cover can be viewed from the outside of the bag through the transparent front and rear walls of the bag. The smaller folded bedding articles positioned within the folded bed cover can not be viewed from the outside of the bag. A flyer typically is inserted inside the bag between the folded bed cover and one of the transparent front or rear bag walls to be viewed through the transparent wall. This flyer often illustrates the various bedding articles in the ensemble and provides other information and advertisement to the potential purchaser.

Although this BED-IN-A-BAG® bedding ensemble display and carrying package has enjoyed commercial success, it does provide certain problems and lacks certain features, which have now been found desirable in such a package. For example, it does not provide views from the outside of all of the folded articles in the bedding ensemble. Moreover, it fails to provide a sturdy, box-shaped package which can be stacked, if desired, without use of racks. It also does not provide a package, which shields from view the undesirable folded edges or ends of the bedding ensemble articles. Lastly, it does not provide a high-end package which is pleasing to the purchaser.

OBJECT AND SUMMARY OF THE INVENTION

It is the object of this invention to overcome the above problems and shortcomings in previous display and carrying packages for an ensemble of products of different sizes, particularly a bedding ensemble, and to provide a display and carrying package which is characterized by providing views from the outside of each product of the ensemble contained within the package and to provide other desired features.

By this invention, it has been found that the above object may be accomplished by providing a display and carrying package, particularly adapted for displaying and carrying a bedding ensemble but which could be used for displaying and carrying any ensemble of products of different sizes, The package is in the form of a closed flexible bag (preferably box-shaped) having generally flat transparent front and rear walls (and preferably having at least partially non-transparent side and top walls connected thereto). The bag includes means (preferably in the form of a zipper connecting the top wall to some of the side, front and rear walls) for closing and opening the bag to provide access to the interior of the bag. An ensemble of products of different sizes (preferably a bedding ensemble including a folded bed cover and other folded bedding articles of smaller folded sizes) is positioned inside the bag with the large ensemble product in juxtaposition to the transparent front bag wall for viewing therethrough and the other smaller ensemble products are positioned inside the bag in juxtaposition to the rear transparent bag wall and in side-by-side position for being viewed from the outside through the transparent rear bag wall. Preferably, the bag includes pockets positioned on the transparent rear bag wall (preferably on the inside) in the side-by-side relationship for receiving and holding the smaller ensemble products in the desired positions for viewing through the transparent rear bag wall.

Preferably, the transparent front wall and the transparent rear wall over each of the smaller ensemble products include frosted semi-transparent strips containing desired printing thereon and providing a background for rendering the printing easily readable on the transparent front and rear walls while allowing views of the ensemble products therethrough. Preferably, the front and rear walls of the bag are constructed of transparent plastic material and the side and top walls are constructed of non-transparent textile cloth material. It is also a preferred feature of this invention that one of the non-transparent sidewalls includes a transparent pocket (preferably positioned on an outside surface thereof) for receiving and displaying a flyer relating to the specific product ensemble packaged within the bag. It is also preferred to provide a handle (preferably attached to the top wall of the bag) for carrying of the package.

The package may also include in one of its preferred forms reinforcement means for at least some of the walls of the bag for aiding in maintaining the preferred box shape of the bag to assist in any desired stacking of the packages.

BRIEF DESCRIPTION OF THE DRAWINGS

While some of the objects and advantages of this invention have been set forth above, other objects and advantages will be clear from the detailed description of the preferred embodiment of this invention, when taken in conjunction with the accompanying drawings, in which.

DETAILED DESCRIPTION OF PREFERRED EMBODIMENT OF THE INVENTION

Figure 1:
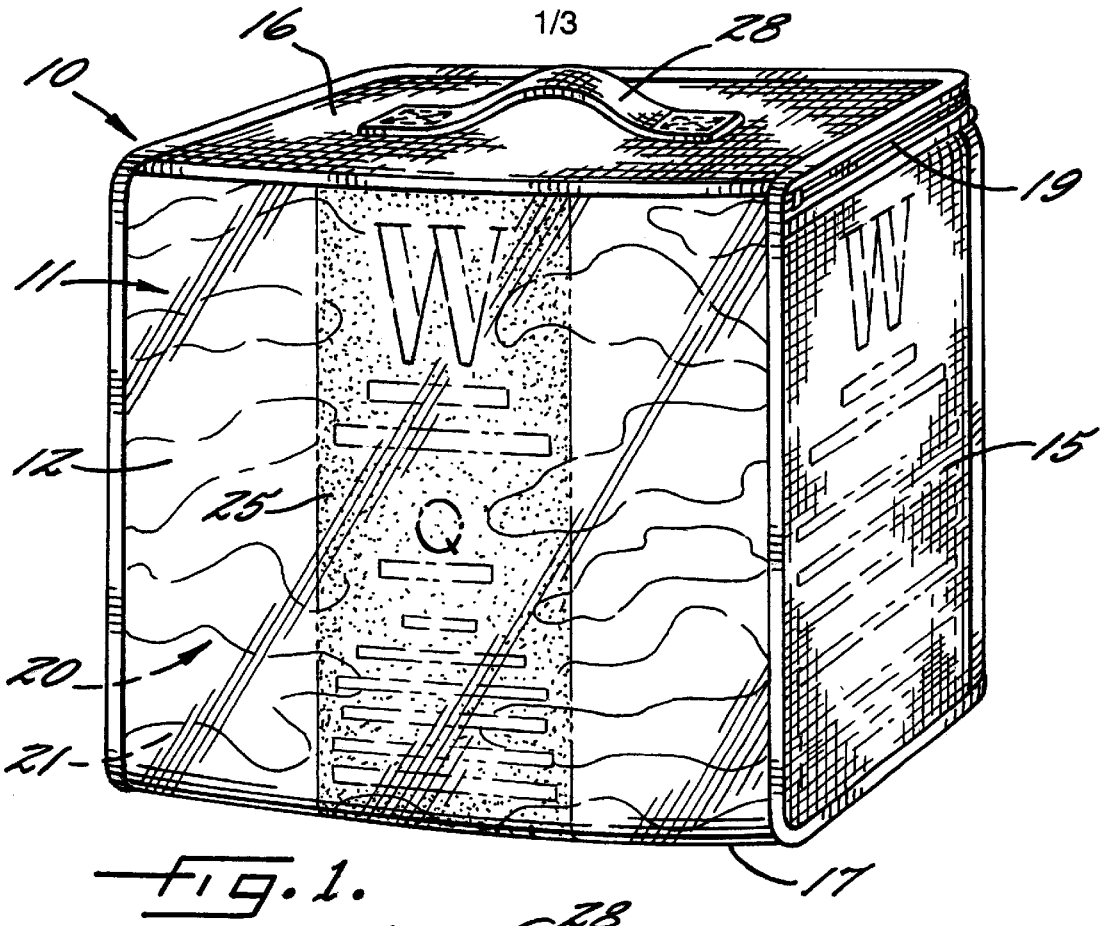
FIG. 1 is a perspective view illustrating particularly the front wall, one sidewall and the top wall of the preferred embodiment of a display and carrying package having a bedding ensemble positioned therein.

Referring now to the drawings, there is illustrated therein a preferred embodiment of a display and carrying package, generally indicated at 10, for an ensemble of products of different sizes, generally indicated at 20. The preferred embodiment of package 10 in accordance with this invention is specifically designed for displaying and carrying a bedding ensemble 20; however, it is to be understood that many of the novel aspects of the package 10 illustrated and described in this preferred embodiment are suitable for use with ensembles of other products of different sizes and the invention is not intended to be limited other than as set forth in the claims following this detailed description of the preferred embodiment.

The package 10 is in the form of a closed flexible bag 11 having generally flat transparent front and rear walls 12 and 13. In the preferred form, the bag 11 is box-shaped and includes at least partially non-transparent sidewalls 14, 15 and a non-transparent top wall 16 and a bottom wall 17 of any desired construction. The bag 11 further includes means 19 for closing and opening the bag to provide access to the interior of the bag. This means 19 is preferably in the form of a zipper connecting the top wall 16 to some of the sidewalls 14, 15 and the front and rear walls 12, 13. As shown in the drawings, this zipper 19 connects the top wall 16 to the sidewalls 14, 15 and the rear wall 13 of the bag 11 and is secured by stitching, binding or the like to the front wall 12. All of the walls 12, 13, 14, 15, 16 and 17 may be suitably secured together by stitching, binding or the like.

Figure 4:
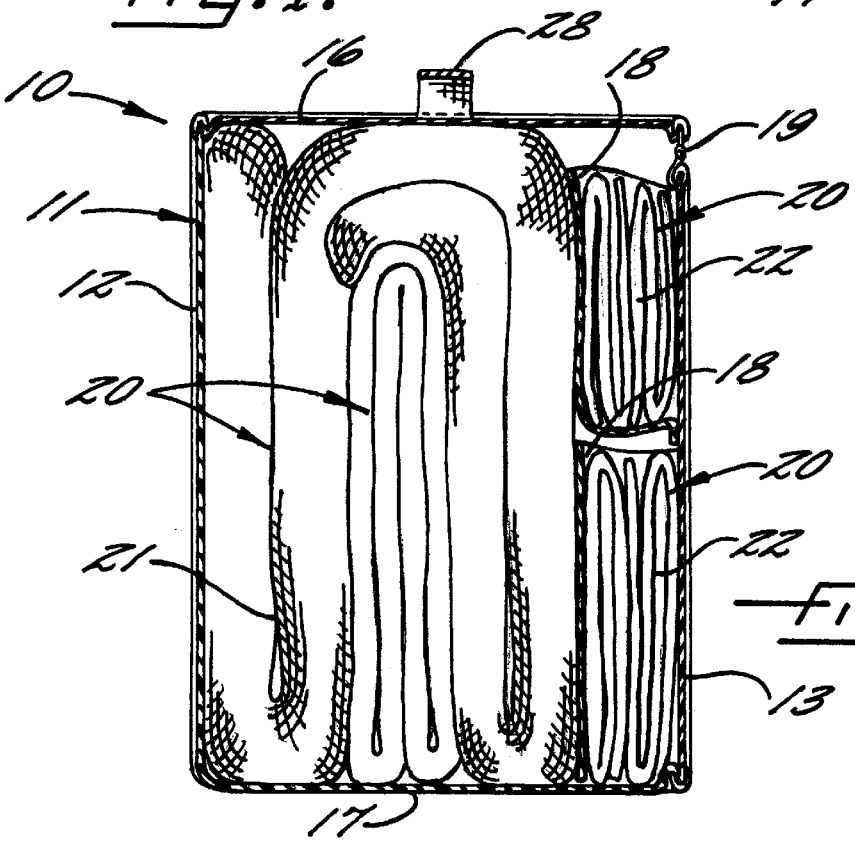
FIG. 4 is a sectional view, taken generally along the line 4—4 of FIG. 2, and illustrating the side views of the folded articles of the bedding ensemble positioned within the package and which are preferably shielded by the non-transparent sidewall.
Figure 2:
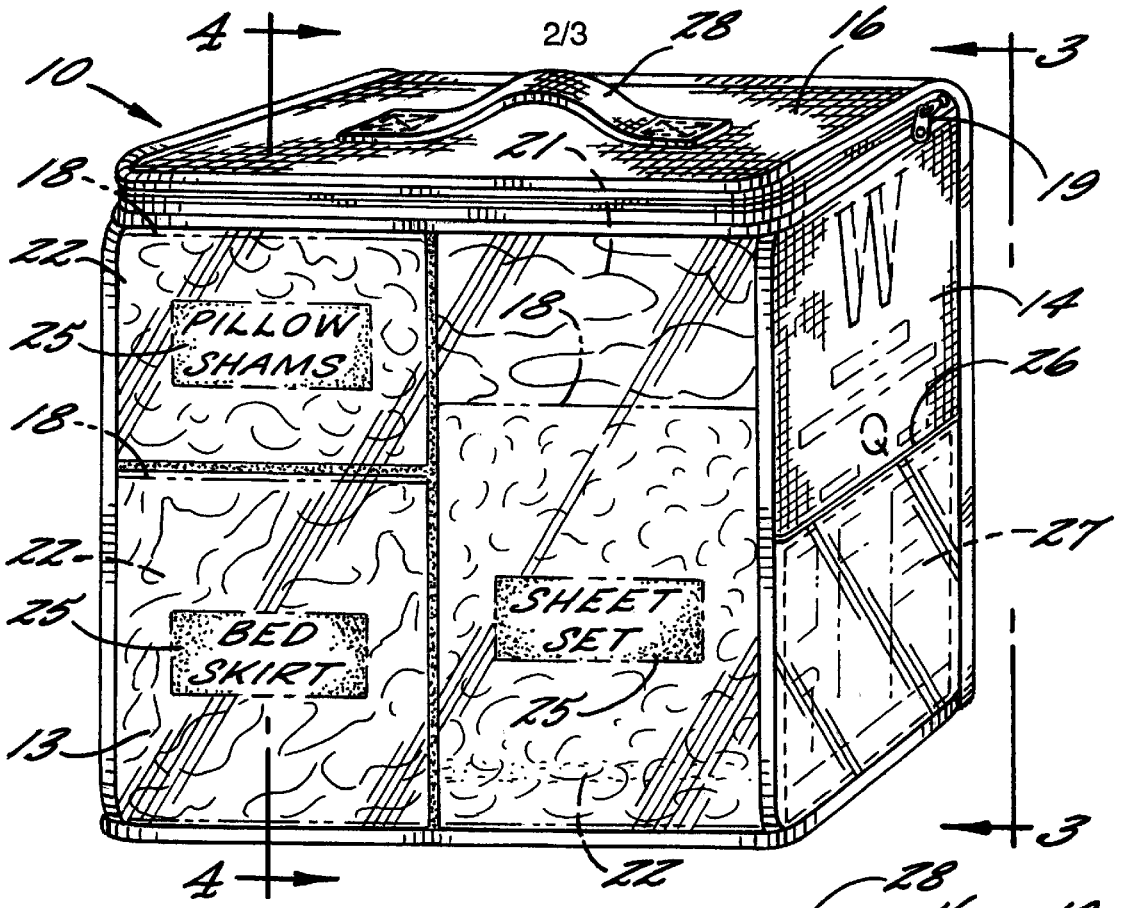
FIG. 2 is a perspective view, like FIG. 1, illustrating the rear wall, the other sidewall and the top wall of the display and carrying package of FIG. 1 having a bedding ensemble therein.
Figure 3:
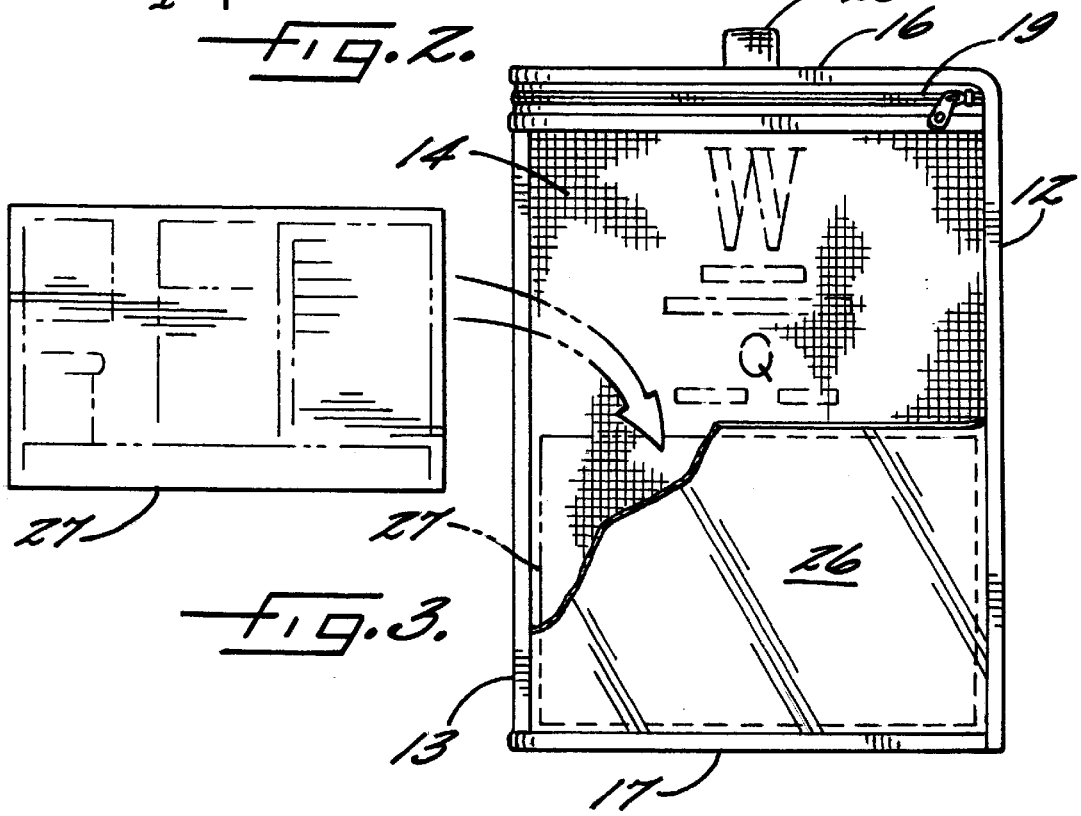
FIG. 3 is a view of one of the sidewalls of the display and carrying package of FIG. 1, taken generally along the line 3—3 of FIG. 2, and illustrating a transparent pocket on this package sidewall and a flyer in exploded position for being positioned within the transparent pocket.

The bedding ensemble 20 positioned inside the bag 11 preferably includes a folded bed cover 21 of a folded size generally corresponding to the size of the front bag wall 12 and being positioned inside the bag 11 in juxtaposition to the front bag wall 12 for viewing through the transparent front bag wall 12 (as shown in FIG. 1). The bedding ensemble 20 also includes other smaller folded bedding articles 22, which may include sheets, pillow covers, bed skirts, etc., and which are positioned inside the bag 11 in juxtaposition to the rear bag wall 13 and in side-by-side positions relative to each other for viewing through the transparent rear bag wall 13 (as shown in FIG. 2). Preferably, the bag 11 includes pockets 18 (see FIG. 4) positioned on the transparent rear bag wall 13 in side-by-side relationship for receiving and holding the other folded bedding articles 22 in the desired positions for viewing through the transparent rear bag wall 13 (as shown in FIG. 2). These pockets 18 are preferably positioned on the inside of the transparent rear bag wall 13 and are open at the top of the pockets 18 (as shown in FIG. 4) for insertion of the other folded bedding articles 22. However, the pockets could be positioned on the outside of the rear bag wall or the pockets 18 could be accessible from the outside of the rear bag wall 13 by openings through the bag wall 13.

The transparent front and rear walls 12, 13 of the bag 11 may be constructed of transparent plastic material and the side and top walls 14, 15, 16 may be constructed of non-transparent textile cloth material, such as canvas or the like. Although these are the preferred materials, any transparent and non-transparent materials may be used for these bag walls. When the bedding ensemble 20 including the bedding articles 21, 22 are positioned as described above in the bag 11, the non-transparent side and top walls 14, 15, 16 provide a shield to the viewing of the folded sides of the folded bedding articles 21, 22 (which are shown in FIG. 4). Normally, it is not desirable to see these folded side edges, but rather to see only the faces of the bedding articles (as shown in FIGS. 1 and 2) through the transparent front and rear walls 12, 13 of the bag 11. The pockets 18 may be of less height than the transparent rear wall 13 in at least one position thereof so that the bedding article 21, as well as the other bedding articles 22 may all be viewed through the transparent rear bag wall 13 (as shown in FIG. 2).

For identifying the contents of the ensemble 20 within the bag 11 of the package 10, frosted semi-transparent strips 25 containing desired printing thereon are suitably positioned on the transparent front wall 12 and the transparent rear wall 13 of the bag 11 to provide a background for rendering the printing easily readable on the transparent front and rear walls 12, 13 while allowing viewing of the bedding ensemble 20 therethrough. As shown in the drawings, the frosted semi-transparent strip 25 on the transparent front wall 12 is in the form of a vertical strip positioned centrally of the wall 12 and containing desired printing to identify the manufacturer, etc. of the package. As may be seen in FIG. 1, the printing on this frosted semi-transparent strip 25 may be clearly seen while the design (clouds) on the bedding ensemble article 21 is visible therethrough. On the transparent rear wall 13 of the bag 11, the semi-transparent frosted strips 25 are positioned over each of the smaller folded bedding articles (which may have the same or different designs than the article 21) and include identifying printing to indicate to the user what is displayed in the package and which may be seen through the transparent rear wall 13. These frosted semi-transparent strips 25 may be formed in any suitable manner on the clear transparent walls 12, 13 and the technologies for forming such frosted semi-transparent strips are well known to those with skill in the art and need not be further described herein.

In accordance with a preferred form of package 10 in accordance with this invention, one of the non-transparent sidewalls 14 includes a transparent pocket 26 positioned on the wall 14 (preferably on an outside surface thereof) for receiving and displaying a flyer 27 which may further identify all of the contents of the ensemble 20 within the bag 11 of the package 10. This flyer, of course, may change when the ensemble 20 within the bag 11 of the package 10 changes. The transparent pocket 26 may be formed of any suitable transparent material, such as the transparent plastic used to form the front and rear walls 12, 13 of the bag 11. The transparent pocket 26 may also be formed on the inside of one of the side walls 14 in which case the lower portion of the side wall 14 would be constructed of transparent material and access to the pocket could be either from the top of the pocket or through the wall 14, as desired.

It is also preferred to provide a handle 28 secured to the top wall 16 of the bag 11 for carrying the package 10. The handle 28 may alternatively be secured to one of the side walls 14 in the event that it is determined that the weight of the ensemble puts undue stress on the zipper 19 which is preferably used as the opening means for the bag 10.

Figure 5:
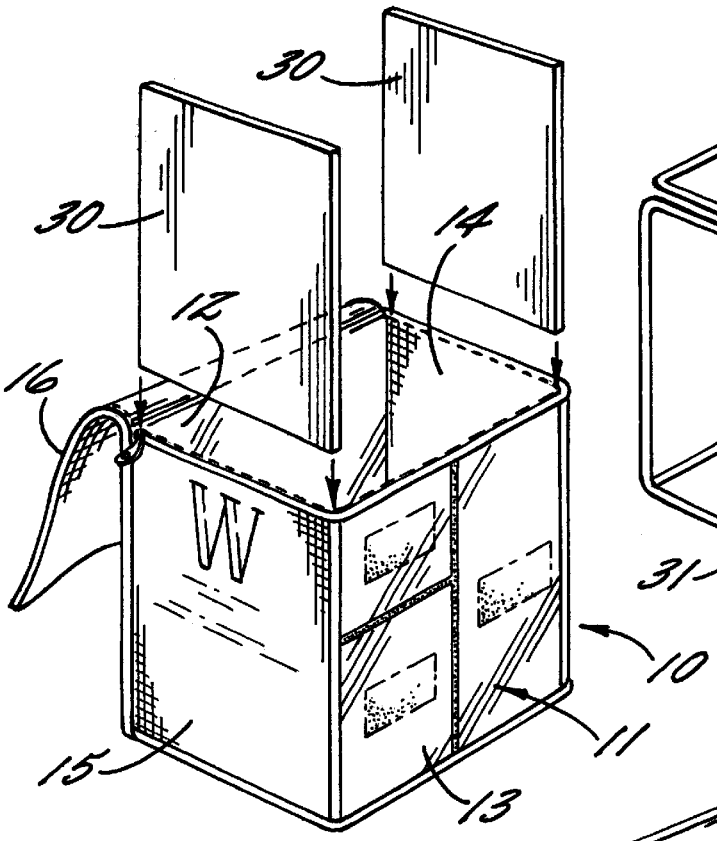
FIG. 5 is a perspective view with the top wall opened up and illustrating reinforcing means, in exploded positions, for at least some of the bag walls in the form of stiff panels which may be positioned against some of the bag wall positions.
Figure 6:
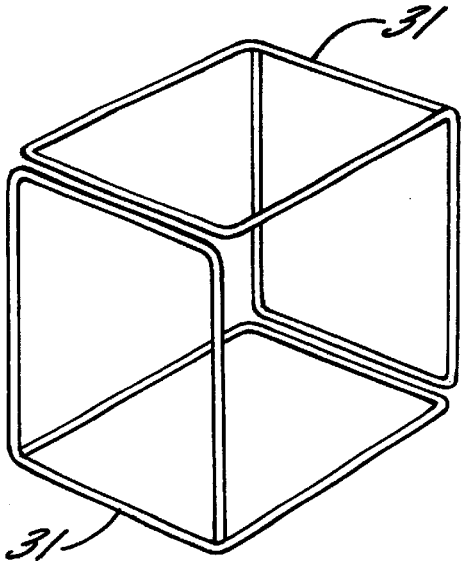
FIG. 6 is a view of an alternative form of reinforcing means in the form of rod framing which can be positioned on the inside of the package.

Referring now to FIGS. 5 and 6, the package 10 may further include reinforcing means for at least some of the walls 12, 13, 14, 15, 16, 17 of the bag 11 for aiding in maintaining the box shape of the bag 11 to assist in any desired stacking of the packages 10. As shown in FIG. 5, this reinforcing means may be in the form of stiff panels 30 which may be formed of foamed plastic or any suitable material, and which are adapted to be positioned against the sidewall 14, 15. The reinforcing means may also be in the form of a steel rod framing 31 which is generally of a box shape and which is designed to be positioned inside the bag 11 to maintain the box shape of the bag 11.

Figure 7:
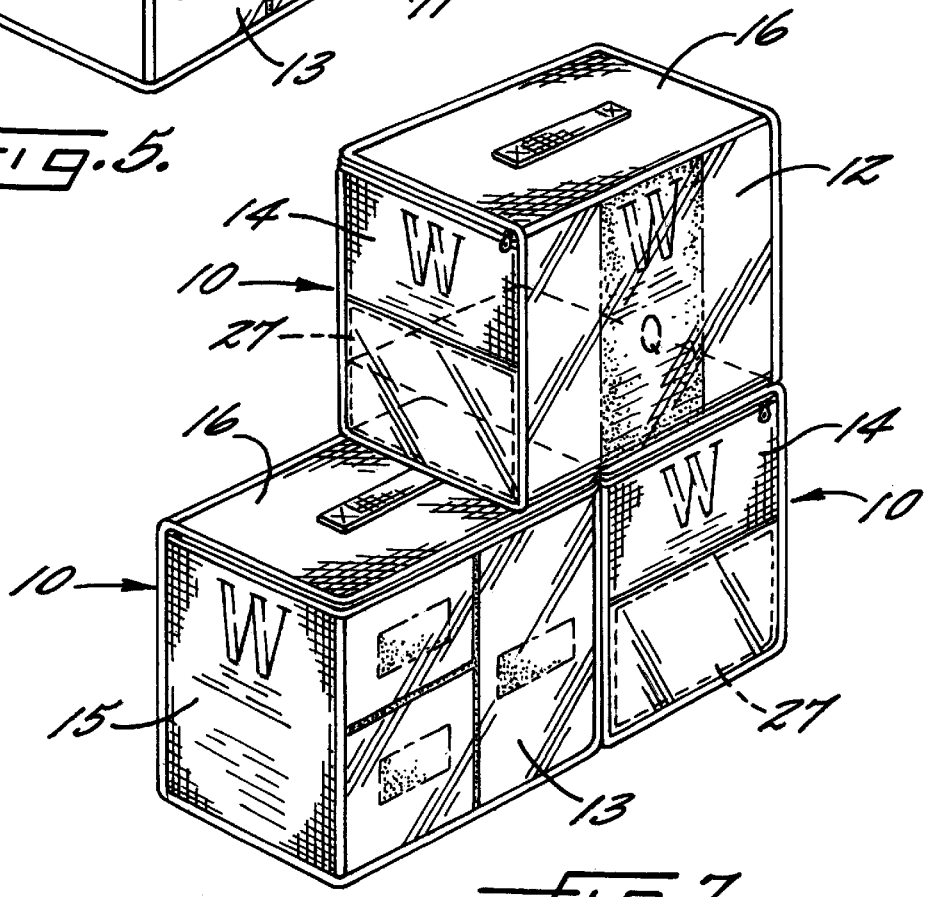
FIG. 7 is a perspective view illustrating how three of the packages may be stacked to display different sides and ends of the package from one side thereof for providing perspective purchasers with different views of the package and the product ensemble contained therein.

The product ensemble display and carrying package 10 of this invention may be stacked, without the use of a display counter or rack, as shown in FIG. 7 in such a manner that different front, rear and sidewalls 12, 13, 14, 15 may be displayed on the front of the stack so as to provide a view through the transparent front and rear walls 12, 13 of all of the articles in the ensemble 20 contained within the package 10 and to provide a view of the printing or flyer 27 contained on the sidewalls 14, 15. The reinforcing means 30 or 31 could be utilized to assist in maintaining the box-shape of the package 10 for such stacking; although, the box-shaped packages can be stacked without such reinforcing means 30, 31.

Thus, it may be seen, that the invention has provided an improved display and carrying package 10 which may carry an ensemble 20 of any desired product of different sizes, but which is particularly adapted for display and carrying of a bedding ensemble 20 and which is characterized by providing views from the outside of each bedding article 21, 22 within the package 10 and which provides an attractive upscale package 10 which preferably shields from view undesirable folded side edges of the articles 21, 22 of the ensemble 20 and which provides an attractive box-shaped package 10 which can be used repeatedly by a purchaser and which can be stacked for display or storage.

The invention has been described above in considerable detail with respect to its preferred embodiment. However, variations and modifications can be made within the spirit and scope of the invention as described in the foregoing specification and as described in the following claims.

What is claimed is:

1. A bedding ensemble display and carrying package characterized by providing views from outside the package of each bedding article within the package and comprising:

a closed flexible bag including means for closing and opening said bag to provide access to an interior of said bag and having generally flat transparent front and rear walls, and further having a non-transparent top wall;

a plurality of pockets positioned on an inside of said rear bag wall;

a handle attached to said top wall of said bag for carrying said package;

a bedding ensemble including a folded bed cover having a decorative design thereon and being of a folded size generally corresponding to the size of said front bag wall, said bed cover further being positioned inside said bag in juxtaposition to said front bag wall for viewing through said transparent front bag wall, wherein said folded bed cover defines at least one folded face having folded side edges of the bed cover and at least one unfolded face exhibiting no edge folds; and a plurality of other folded bedding articles having at least one design different from the bed cover design and being of folded sizes smaller than said rear bag wall, each of said other folded bedding articles being positioned inside respective pockets on the inside of said bag in juxtaposition to said rear bag wall and in side-by-side position relative to each other for viewing through said transparent rear bag wall; and wherein said folded bed cover is positioned in said flexible bag with said folded face adjacent to said non-transparent top wall which provides a shield to the viewing of the folded side edges, and further wherein said bed cover is positioned with said unfolded face adjacent to said transparent rear wall so that the bed cover can be viewed contemporaneously with the other folded bedding articles and a consumer can compare the design of the bed cover with the design of the other folded bedding articles prior to purchasing the bedding ensemble.

2. A bedding ensemble display and carrying package, as set forth in claim 1, in which said transparent front wall and said transparent rear wall over each of said pockets include frosted semi-transparent strips containing desired printing thereon and providing a background for rendering said printing easily readable on said transparent front and rear walls while allowing views of said bedding ensemble therethrough.

3. A bedding ensemble display and carrying package, as set forth in claim 1, in which said means for closing and opening said bag comprises a zipper connecting said top wall to some of said side walls and said rear wall.

4. A bedding ensemble display and carrying package, as set forth in claim 1, in which said package further includes reinforcing means for at least some of said walls of said bag for aiding in maintaining said box shape of said bag to assist in any desired stacking of said packages.

5. A bedding ensemble display and carrying package, as set forth in claim 4, in which said reinforcing means comprises stiff panels positioned against at least some of said walls of said bag.

6. A bedding ensemble display and carrying package, as set forth in claim 4, in which said reinforcing means comprises rod framing positioned inside said bag.

* * * * *